United States Patent [19]

Kozuka et al.

[11] Patent Number: 4,640,604

[45] Date of Patent: Feb. 3, 1987

[54] ELECTROSTATIC PHOTOGRAPHIC COPYING MACHINE PROVIDED WITH A MOVABLE SORTER

[75] Inventors: Nobuhiko Kozuka; Shigeo Koyama, both of Osaka; Atsushi Kano, Amagasaki, all of Japan

[73] Assignee: Mita Industrial Co., Ltd., Osaka, Japan

[21] Appl. No.: 476,377

[22] Filed: Mar. 17, 1983

[30] Foreign Application Priority Data

Apr. 4, 1982 [JP] Japan ..... 57-49165[U]

[51] Int. Cl.[4] ..... G03G 15/00; G03G 21/00

[52] U.S. Cl. ..... 355/3 R; 271/273; 271/292

[58] Field of Search ..... 355/14 R, 14 SH, 3 R, 355/3 SH; 271/207, 208, 209, 220, 223, 224, 199, 200, 201, 202, 273, 292; 270/58

[56] References Cited

U.S. PATENT DOCUMENTS

| | | | |
|---|---|---|---|
| 3,411,771 | 11/1968 | Bahr et al. | 271/273 |
| 3,744,790 | 7/1973 | Hoffman | 271/292 |
| 3,830,590 | 8/1974 | Harris et al. | 355/14 SH X |
| 3,840,222 | 10/1974 | Fowlie et al. | 355/14 SH X |
| 3,848,995 | 11/1974 | Gauronski | 355/14 R X |
| 3,973,769 | 8/1976 | Cross et al. | 271/173 |
| 4,111,410 | 9/1978 | Tates et al. | 271/173 |
| 4,221,378 | 9/1980 | Kamath et al. | 271/220 |
| 4,286,861 | 9/1981 | Matsumoto et al. | 355/3 R |
| 4,320,961 | 3/1982 | Davis et al. | 355/14 SH |
| 4,327,992 | 5/1982 | Babicz | 355/3 R |
| 4,334,761 | 6/1982 | Saito et al. | 355/3 R |
| 4,370,052 | 1/1983 | Murakami et al. | 355/14 R |
| 4,371,254 | 2/1983 | Beery | 355/14 R X |
| 4,384,781 | 5/1983 | Takada | 271/273 X |
| 4,405,225 | 9/1983 | Perrault | 355/14 SH X |
| 4,449,812 | 5/1984 | Furuichi et al. | 355/14 SH |
| 4,452,525 | 6/1984 | Ogura | 355/14 R |
| 4,456,363 | 6/1984 | Hirabayashi | 355/3 R |

FOREIGN PATENT DOCUMENTS

| | | | |
|---|---|---|---|
| 0002915 | 7/1979 | European Pat. Off. | 355/3 R |
| 0197562 | 12/1982 | Japan | 355/14 SH |

*Primary Examiner*—Fred L. Braun

*Attorney, Agent, or Firm*—Wenderoth, Lind & Ponack

[57] ABSTRACT

An electrostatic photographic copying machine provided with a sorter includes structure for mechanically connecting the sorter to a body of the electrostatic photographic copying machine so that the sorter can be moved between a first position adjacent the body and a second position spaced from the body in the direction of discharge of paper sheets with an interval therebetween. Thereby, copying paper sheets can be easily and rapidly removed from the sorter and a fixing apparatus of the machine if they become stopped up or jammed therein.

4 Claims, 4 Drawing Figures

ELECTROSTATIC PHOTOGRAPHIC COPYING MACHINE PROVIDED WITH A MOVABLE SORTER

BACKGROUND OF THE INVENTION

1. Field of the Invention

The present invention relates to an electrostatic photographic copying machine provided with a sorter for sorting copying papers discharged from a fixing apparatus, the sorter being arranged subsequent to a passage for discharging copying papers from the fixing apparatus.

2. Description of the Prior Art

The images transferred onto sheets of copying paper are fixed by heating under pressure between a pair of rollers in a fixing apparatus of an electrostatic photographic copying machine, and then the copying paper sheets are discharged by means of another pair of rollers. The copying papers discharged from the fixing apparatus are in turn fed into sorting trays by means of a pair of conveying rollers, However, the copying papers are apt to be stopped or jammed in the paris of rollers installed in the fixing apparatus and the sorter.

OBJECT OF THE INVENTION

It is the object of the present invention to provide an electrostatic photographic copying machine, in which copying papers stopped or jammed in a pair of rollers can be easily and rapidly removed.

BRIEF DESCRIPTION OF THE DRAWINGS

Preferred embodiments of the present invention are illustrated in the accompanying drawings, in which.

DESCRIPTION OF THE PREFERRED EMBODIMENTS

Preferred embodiments of the present invention will be described below with reference to the drawings.

Figure 1:
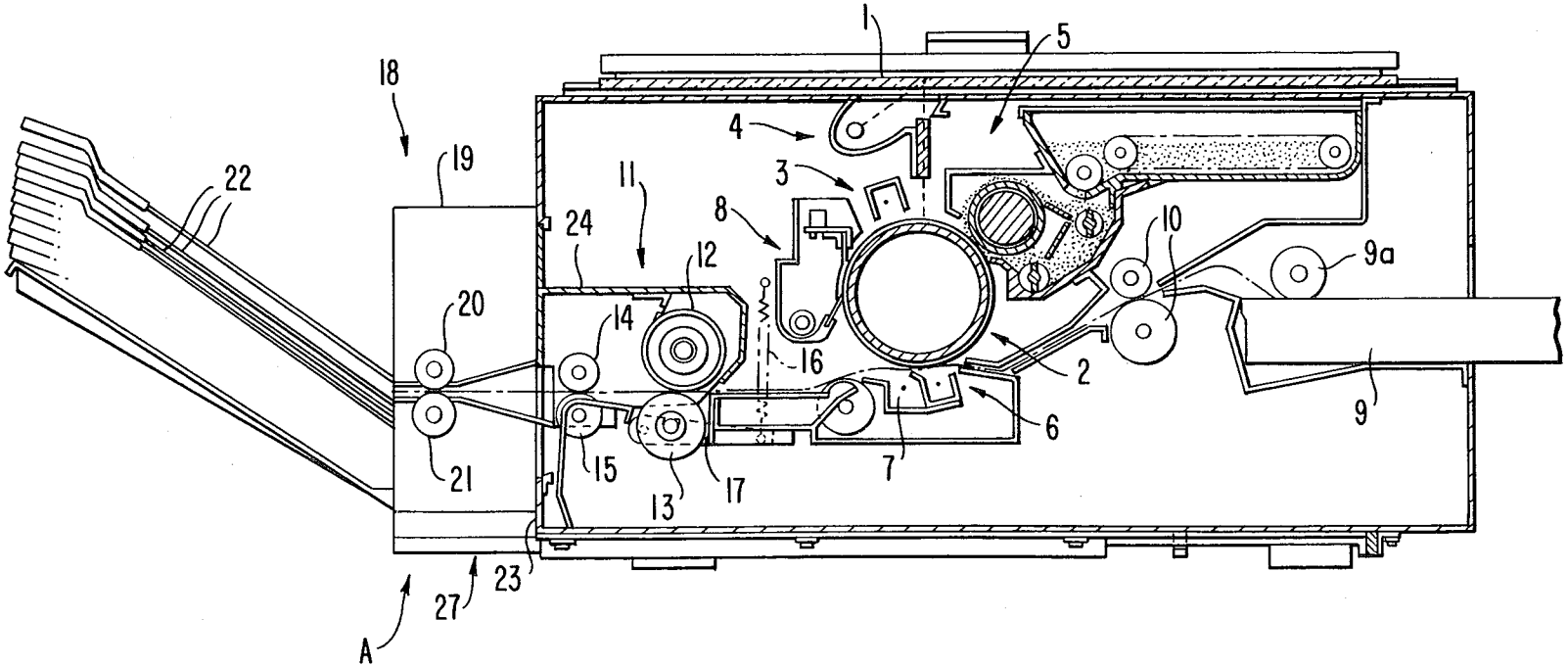
FIG. 1 is a longitudinally sectioned side view showing an electrostatic photographic copying machine provided with a sorter according to the invention, the sorter being shown in a first position thereof.

FIG. 1 shows an electrostatic photographic copying machine provided with a sorter, in which 1 designates a table for supporting a manuscript to be copied, table 1 being moved by means of a driving device (not shown).

A rotary drum 2 has an external surface coated with sensitive material. An electrifying apparatus 3, an exposure apparatus 4, a developing apparatus 5, a transferring apparatus 6, a paper-stripping apparatus 7 and a cleaning apparatus 8 are arranged around rotary drum 2. Copying papers are fed from a paper-feeding cassette 9 into transferring apparatus 6 by means of a pair of rollers 10 (an upper roller and a lower roller) via paper-feeding rollers *9a*, and images are transferred onto the copying papers during the passage thereof through transferring apparatus 6.

A fixing apparatus 11 fixes the images transferred onto the copying papers and includes a pair of fixing rollers 12, 13 (roller 12 being a heating roller, and roller 13 being a pressure roller) and a pair of discharge rollers, including upper roller 14 and lower roller 15. Pressure roller 13 is supported by a pair of arms 17 urged upwardly by a spring 16.

A sorter 18 is arranged subsequent to the passage of the copying papers being discharged form fixing apparatus 11 and includes a pair of conveying rollers 20, 21 installed inside a sorter casing 19. Paper-discharging trays 22, which are lifted upwardly by a predetermined distance every time a sheet of copying paper is fed thereinto, are installed on the rear portion of sorter casing 19 so that copying papers are fed thereto under the condition that the copying papers are positioned upwardly in the order of copying.

Figure 2:
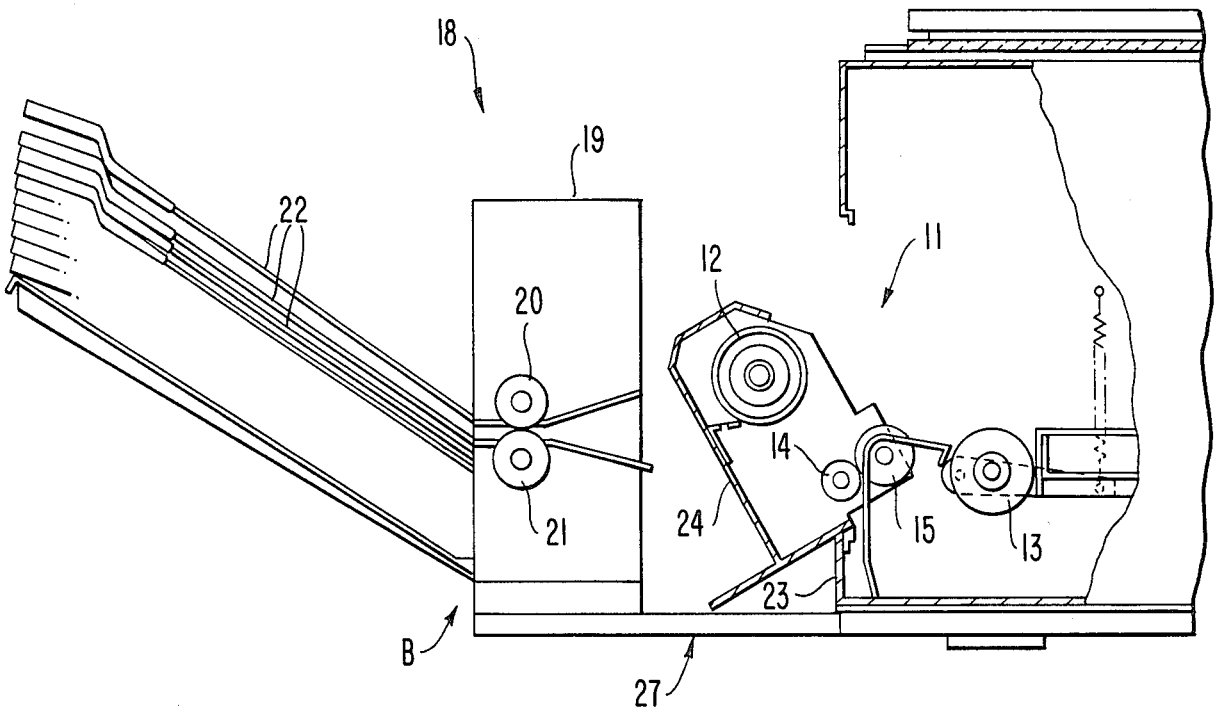
FIG. 2 is a side view showing the main parts of the sorter shown in a second position thereof.

Sorter 18 is mechanically connected with the electrostatic photographic copying machine so as to be movable between a first position A adjacent the body 23 of the copying machine, as shown in FIG. 1, and a second position B spaced from body 23 of the copying machine in the direction of dishcarge of the papers, with an interval therebetween as shown in FIG. 2. Thereby, a space formed between casing 19 and body 23 of the electrostatic photographic copying machine by changing over sorter 18 to second position B. As a result, the copying papers can be easily and rapidly removed from the inside of casing 19 and fixing apparatus 11 when copying papers are stopped up or jammed therein.

The fixing apparatus may be of the type wherein the upper rollers 12, 14 are mounted in an upper casing 24 which is rotatable around the axis of the lower discharging roller 15. Casing 24 is fixedly mounted on body 23 of the copying machine by means of an anchoring mechanism such as a bolt (not shown) so as to engage heating roller 12 with pressure roller 13. In the second position B shown in FIG. 2, copying papers stopped up in fixing apparatus 11 can be easily and rapidly removed by removing the connection by the anchoring mechanism such as a bolt (not shown) an pivoting upper casing 24 to the open position shown in FIG. 2.

Still further, in a fixing apparatus of the type wherein rollers 12, 14 are not rotatable around the axis or roller 15, but rather are fixedly mounted, copying papers stopped up in fixing apparatus 11 can be removed to the discharging rollers side by manually rotating upper rollers 12, 14 or lower rollers 13, 15.

Figure 3:
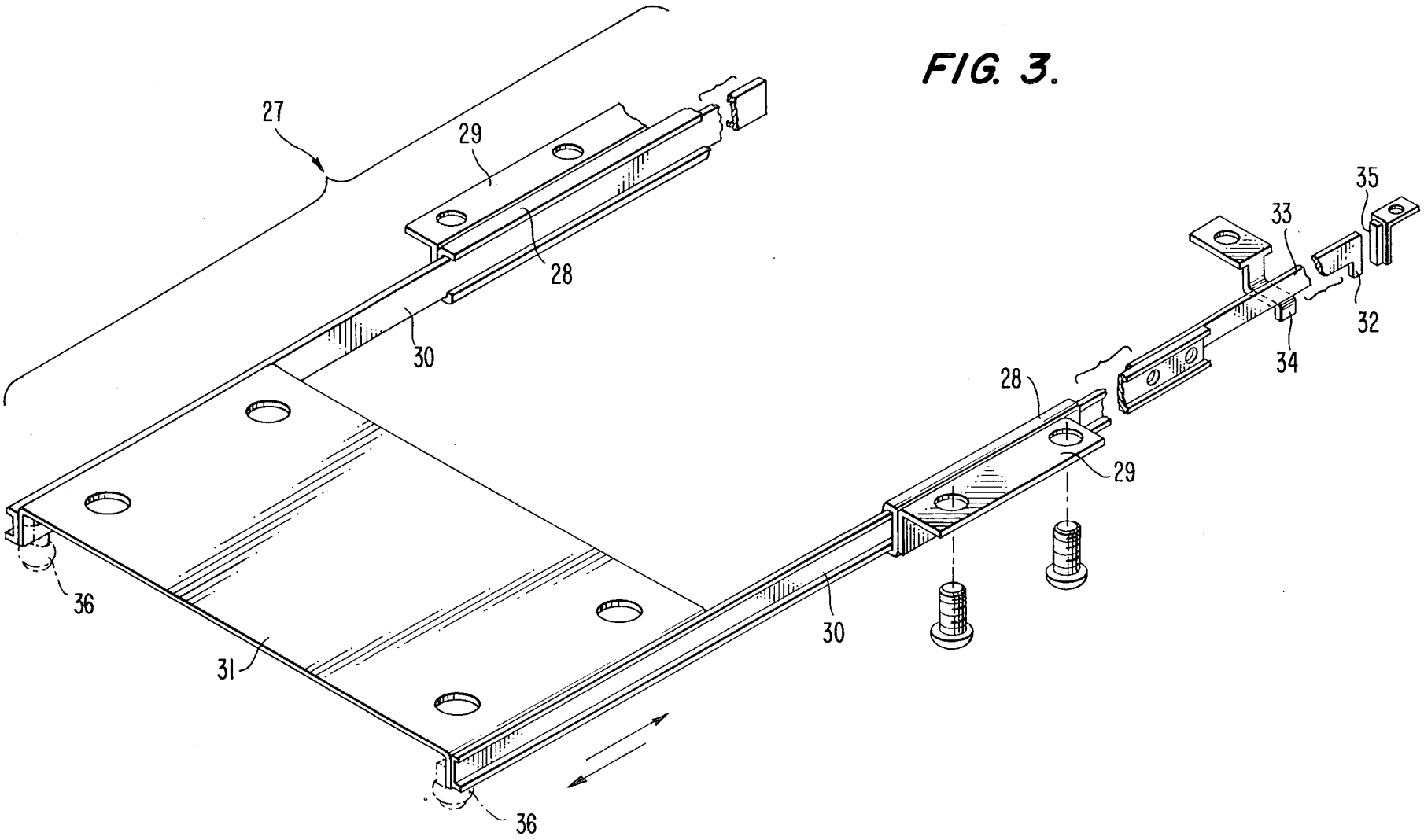
FIG. 3 is a perspective view showing a connecting mechanism partially omitted.

As to the construction of a means 27 for mechanically connecting sorter 18 with the electrostatic photographic copying machine so as to be movable between the two positions A, B, as shown in FIG. 3 a pair of guide members 28 provided with supporting bearings thereinside are connected by means of bolts with opposite lower sides of body 23 of the copying machine along the path of discharging copying papers by respective L-brackets 29. A pair of rails 30 are inserted into guide members 28. Rails 30 are extended slidably in the direction of the discharging papers. A trestle 31 is connected to adjacent ends of rails 30, and sorter 18 is fixedly mounted on trestle 31 by means of bolts.

A position-regulating member 33 provided with an anchoring piece 32 is mounted on an opposite end of one of rails 30, body 23 of the copying machine being provided with a stopper 34 to engage with anchoring piece 32 when sorter 18 is sliding in a direction toward second position B so that second position B may be set. Body 23 of the copying machine is provided with a magnet 35 for attracting magnetically anchoring piece 32 to set sorter 18 at first position A.

In addition, although this position-regulating apparatus has been described as being provided for one rail 30, such apparatus may be provided for both rails 30.

Furthermore, as shown by phantom lines in FIG. 3, rails 30 may be provided with rotary supporting members 36, such as casters, at ends therof.

Figure 4:
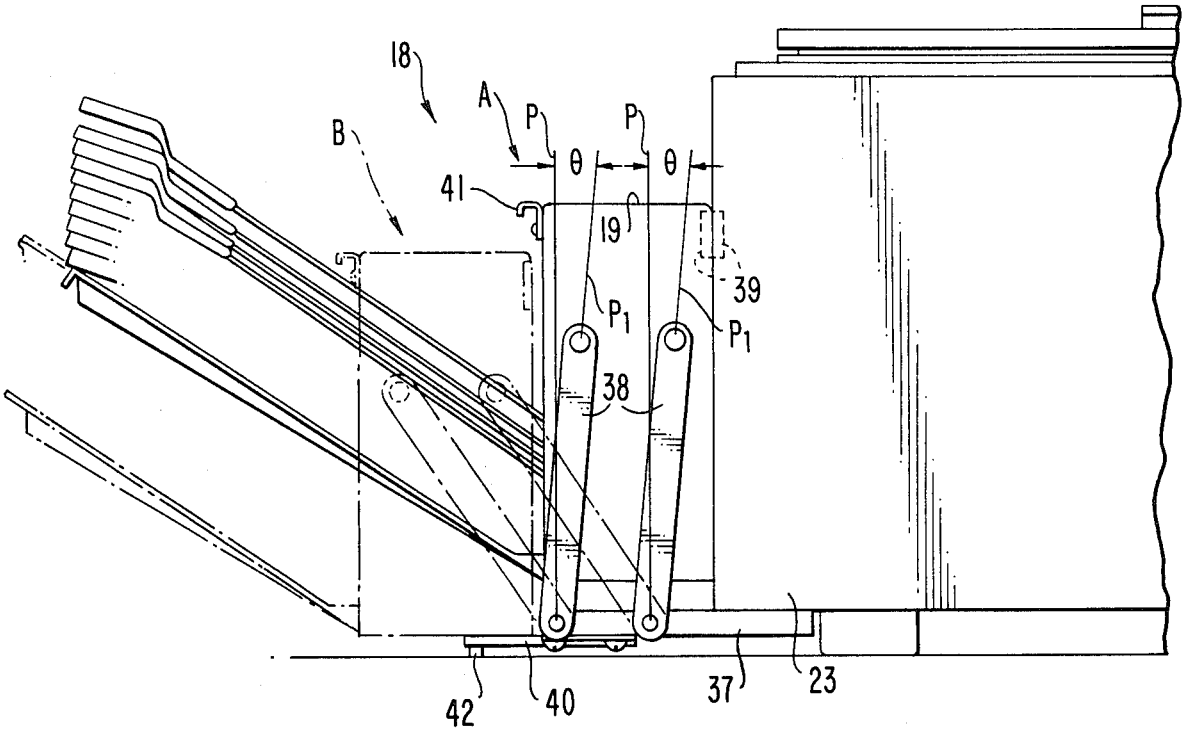
FIG. 4 is a side view of another embodiment of a connecting mechanism.

FIG. 4 shows another embodiment of the connecting structure, wherein body 23 of the copying machine is provided with a pair of link supporting members 37 at lower portions of opposite sides of sorter 18. A pair of parallel links 38 are pivotably connected with each of opposite side portions of sorter casing 19 and to respective of the link supporting members 37. The positions of links 38 are set so that the upper pivoting points of links 38 will be positioned toward body 23 of the copying machine side with respect to perpendicular lines P passing through the lower pivoting points of links 38, when sorter 18 is positioned in first position A engaging sorter casing 19 with body 23 of the copying machine. That is to say, sorter casing 19 will be engaged with body 23 of the copying machine when links 38 extend such that angles $\theta$ are formed between perpendicular lines P and lines $P_1$ extending through the upper and lower pivoting points of links 38. Sorter 18 will be stabilized in first position A by gravity due to the weight of sorter 18. Magnets 39 installed at surfaces where sorter casing 19 is engaged with body 23 of the copying machine secure first position A of sorter 18 due to magnetic attraction. Sorter 18 can be changed over to second position B by moving sorter 18 against such magnetic attraction and the weight of sorter 18. Link supporting members 37 are provided with a support extension 40 supporting sorter 18 at second position B. Sorter casing 19 is provided with a handle 41 for use in moving sorter 18 between the two positions A, B.

Supporting extension 40 may be provided at the lower portion thereof with an elastic supporting means 42 made of an elastic material such as rubber. Alternatively, support extension 40 may be omitted, and elastic supporting means 42 may be provided on the lower surface of sorter casing 19. In addition, link supporting members 37 may be plate-like members.

Furthermore, a spring for urging sorter 18 toward first position A side may be mounted on the lower pivoting portion of one link 38, and such spring may be a spiral spring. In this case, the activation force of the spring is used for positioning sorter 18 at first position A, and sorter 18 can be changed over to the two positions A, B by a relatively small force.

As described above, an electrostatic photographic copying machine provided with a sorter according to the present invention is provided with a means for mechanically connecting the sorter with a body of the electrostatic photographic copying machine so that the sorter may be moved between a first position adjacent the body of the copying machine and a second position spaced from the body of the copying machine in the direction of discharge of papers with an interval therebetween. Thereby, there if formed between the sorter and the body a space for eliminating troubles such as copying papers stopped up or jammed in the sorter or the fixing apparatus, simply by moving the sorter to the second position thereof. As a result, the copying papers can be easily and rapidly removed from the inside of the sorter casing and the fixing apparatus when the copying papers are stopped up or jammed therein. Further, the changing over operation between the first position and the second position can be rapidly carried out, since the sorter is mechanically connected with the electrostatic photographic copying machine, and at the same time the positioning control of the sorter can be easily and correctly carried out when changing over the sorter to the first position from the second position. Thus, an electrostatic photographic copying machine according to the present invention provides superior maneuverability in comparison with an electrostatic photographic copying machine in which a sorter is fixedly mounted thereon, e.g. by means of a vise.

What is claimed is:

1. In an electrostatic photographic copying machine of the type including a machine body, means for electrostatically transferring copied images to sheets of copying paper moved in a feed direction, means for fixing said images on said sheets and discharging said sheets in said direction, and a sorter mounted on said body for receiving and sorting said discharged sheets, the improvement comprising:

means for mounting said sorter on said body such that the entire said sorter is selectively movable, in said direction of discharge of said sheets, between a first position mechanically connected to said body, whereat said sorter is adjacent said body and said fixing means for receipt therefrom of said discharged sheets, and a second position mechanically connected to said body, whereat said entire sorter is spaced in said direction form said body and said fixing means, with a space between said sorter and said fixing means sufficiently large to enable removal of any sheets jammed in said sorter or said fixing means, said mounting means comprising link supporting members fixed to opposite sides of a lower portion of said body and extending therefrom in said direction, pairs of parallel links connecting said sorter to said link supporting member, each said link having a lower first end pivotally connected to a respective said link supporting member and an upper second member pivotally connected to a respective side of said sorter, whereby said sorter is movable between said first and second positions by pivoting said links about said lower first ends thereof.

2. The improvement claimed in claim 1, further comprising magnet means for attracting said sorter to said first position thereof.

3. In an electrostatic photographic copying machine of the type including a machine body, means for electrostatically transferring copied images to sheets of copying paper moved in a feed direction, means for fixing said images on said sheets and discharging said sheets in said direction, and a sorter mounted on said body for receiving and sorting said discharged sheets, the improvement comprising:

means for mounting said sorter on said body such that the entire said sorter is selectively movable, in said direction of discharge of said sheets, between a first position mechanically connected to said body, whereat said sorter is adjacent said body and said fixing means for receipt therefrom of said discharged sheets, and a second position mechanically connected to said body, whereat said entire sorter is spaced in said direction from said body and said fixing means, with a space between said sorter and said fixing means sufficiently large to enable removal of any sheets jammed in said sorter or said fixing means, said mounting means comprising a pair of guide members mounted below said body and extending in said direction, a pair of rails extending into and supported by said guide members, said rails being slidable within respective said guide members in said direction, a trestle connecting adjacent outer ends of said rails, said sorter being fixedly supported on said trestle, a stopper member mounted on said body, a position-regulating member at an inner end of at least one of said rails and having an anchoring member positioned to abut said stopper member to limit movement of said rails and said sorter in said direction and thereby to set said second position, and magnet means on said body for magnetically attracting said anchoring member and thereby for positioning said sorter at said first position.

4. The improvement calimed in claim 3, wherein said fixing means comprises a casing, upper and lower fixing rollers, and upper and lower discharging rollers, said upper fixing and discharging rollers being mounted on said casing, and said casing being pivotable with respect to said body about the axis of said lower discharging roller between a fixing position within said body and an open position directed toward said sorter, and wherein when said sorter is in said second position thereof said space is sufficiently large to accommodate said casing when said casing is in said open position thereof.

* * * * *